US012221755B2

(12) United States Patent
Unterholzner et al.

(10) Patent No.: US 12,221,755 B2
(45) Date of Patent: Feb. 11, 2025

(54) SNOW TILLER FOR THE PREPARATION OF SKI RUNS

(71) Applicant: PRINOTH S.P.A., Vipiteno (IT)

(72) Inventors: Markus Unterholzner, Vipiteno (IT); Stefan Hochrainer, Vipiteno (IT)

(73) Assignee: PRINOTH S.P.A., Vipiteno (IT)

( * ) Notice: Subject to any disclaimer, the term of this patent is extended or adjusted under 35 U.S.C. 154(b) by 769 days.

(21) Appl. No.: 17/429,566

(22) PCT Filed: Feb. 12, 2020

(86) PCT No.: PCT/IB2020/051142
§ 371 (c)(1),
(2) Date: Aug. 9, 2021

(87) PCT Pub. No.: WO2020/165799
PCT Pub. Date: Aug. 20, 2020

(65) Prior Publication Data

US 2022/0106750 A1 Apr. 7, 2022

(30) Foreign Application Priority Data

Feb. 12, 2019 (IT) ..... 102019000002017

(51) Int. Cl.
*E01H 4/02* (2006.01)

(52) U.S. Cl.
CPC ..... *E01H 4/02* (2013.01)

(58) Field of Classification Search
CPC .... E01H 4/02; E01H 5/12; E01H 4/00; E01H 4/023; A01B 33/16
See application file for complete search history.

(56) References Cited

U.S. PATENT DOCUMENTS 4,726,129 A * 2/1988 Haug ..... E01H 4/02 172/197
4,788,783 A * 12/1988 Bachler ..... E01H 4/02 37/220

(Continued)

FOREIGN PATENT DOCUMENTS

CN 106884401 A * 6/2017
CN 107923135 A 4/2018

(Continued)

OTHER PUBLICATIONS

Office Action and Search Report for Chinese Application No. 2020800134546 dated Dec. 29, 2022 with translation (15 pages).

(Continued)

*Primary Examiner* — Adam J Behrens
*Assistant Examiner* — Blake E Scoville
(74) *Attorney, Agent, or Firm* — Neal, Gerber & Eisenberg LLP

(57) ABSTRACT

A snow tiller for the preparation of ski runs, has a frame extending symmetrically on opposite sides with respect to a longitudinal axis; a tiller module coupled to the frame and having a shaft; and a casing, which is arranged around the shaft; a finisher, which has a flexible mat with one end coupled to the casing; and a pressure bar that is fixed to the flexible mat; and an adjusting assembly connected to the pressure bar and to the frame and/or to the casing and configured to enable a free oscillation of the pressure bar around an axis parallel to the longitudinal axis of the snow tiller and to selectively actuate a controlled adjustment of the distance between the pressure bar and the casing.

8 Claims, 6 Drawing Sheets

(56) References Cited

U.S. PATENT DOCUMENTS

| | | | | | |
|---|---|---|---|---|---|
| 4,897,941 | A * | 2/1990 | Sinykin | E01H 4/02 | 172/684.5 |
| 5,067,264 | A * | 11/1991 | Beeley | E01H 4/02 | 172/112 |
| 5,659,984 | A * | 8/1997 | Haug | C07F 9/65742 | 37/219 |
| 7,546,700 | B2 * | 6/2009 | Westmont | E01H 4/02 | 37/223 |
| 8,230,622 | B2 * | 7/2012 | Dalla Torre | E01H 4/02 | 37/219 |

FOREIGN PATENT DOCUMENTS

| | | | |
|---|---|---|---|
| CN | 207582403 | U | 7/2018 |
| DE | 41 01 617 | A1 | 7/1991 |
| WO | WO 2009/034185 | A1 | 3/2009 |
| WO | WO 2019/162900 | A1 | 8/2019 |

OTHER PUBLICATIONS

Office Action for European Application No. 20 705 119.4 dated Sep. 8, 2023 (7 pages).

Notification Concerning Submission, Obtention or Transmittal of Priority Document for International Application No. PCT/IB2020/051142 dated Jun. 12, 2020.

International Search Report and Written Opinion for International Application No. PCT/IB2020/051142 dated May 12, 2020.

* cited by examiner

SNOW TILLER FOR THE PREPARATION OF SKI RUNS

PRIORITY CLAIM

This application is a national stage application of PCT/IB2020/051142, filed on Feb. 12, 2020, which claims the benefit of and priority to Italian Patent Application No. 102019000002017, filed on Feb. 12, 2019, the entire contents of which are each incorporated by reference herein.

TECHNICAL FIELD

The present disclosure relates to a snow tiller for the preparation of ski runs.

BACKGROUND

Generally, a snow tiller for the preparation of ski runs comprises a frame; a rotating shaft; a plurality of tools that protrude from the shaft; a casing arranged around the shaft and delimiting a processing chamber in which the snow is processed by the tools; and a finisher that, in this case, comprises a pressure bar and a flexible mat, which is connected to one end of the casing and has the function of compacting the tilled snow.

The snow tiller is generally dragged over the snow cover by a tracked vehicle in a traveling direction via a drawbar.

The snow tiller, at the rear, rests on the snow cover, in this case, the snow tiller rests on the finisher and, at the front, is supported by the drawbar, which is, in turn, connected to and controlled by the tracked vehicle.

As is known, the properties of a ski run's snow cover, such as the thickness and mechanical properties of the snow, vary within relatively very wide ranges depending on the weather conditions. Therefore, the optimal preparation of a ski run is conditioned by the properties of the snow cover itself which can vary considerably both depending on the area of the processed run and over relatively short periods of time. In particular, the optimal preparation of a ski run involves eliminating irregularities in the snow cover in order to achieve an aesthetically pleasing snow cover. This operation is particularly relatively complicated, given the considerable variability of the snow cover properties (e.g., in the case of ski runs that have both areas of frozen snow cover and areas of relatively soft snow cover).

SUMMARY

The purpose of the present disclosure is to provide a snow tiller that mitigates certain other drawbacks of certain of the prior art.

In accordance with the present disclosure, a snow tiller is provided for the preparation of the snow cover of ski runs, the snow tiller being configured to be advanced in a traveling direction and comprising: a frame extending symmetrically on opposite sides with respect to a longitudinal axis that is parallel to the traveling direction; at least one tiller module coupled to the frame and comprising a shaft, which rotates around a rotation axis transversal to the longitudinal axis and is equipped with a plurality of tools configured to penetrate the snow cover; and a casing, which is arranged around the shaft a finisher, which comprises a flexible mat, which is configured to define a support area for the snow tiller on the snow cover and comprises an end coupled to the casing; and a pressure bar that extends transversely to the longitudinal axis, and is fixed to the flexible mat at a distance from the end coupled to the casing; and at least one adjusting assembly connected to the pressure bar and to the frame and/or to the casing and configured to enable the pressure bar to freely oscillate around an axis parallel to the longitudinal axis of the snow tiller and to selectively adjust the distance between the pressure bar and the casing.

In accordance with the present disclosure, the controlled adjustment of the distance between the pressure bar and the casing makes it possible to adjust the configuration of the flexible runt portion between the pressure bar and the easing, which can selectively determine an accumulation of a suitable amount of tilled snow between the pressure bar and the casing to fill in irregularities in the snow cover in order to obtain a relatively aesthetically pleasing: snow cover. In practice, the portion of flexible mat between the pressure bar and the casing can take on a plurality of configurations between an extended configuration, to be used in fresh snow conditions, and an arched configuration, with a concavity facing upwards, to increase the accumulation of snow in the processing chamber and the levelling of irregularities in the snow cover. This second configuration is to be used when there is relatively compact snow. In other words, when the snow cover is icy, a greater accumulation of snow is required to fill any holes or unevenness in the snow cover, while in relatively soft snow conditions, the snow tiller can operate with lower snow accumulations. As such, the present disclosure enables an optimal and aesthetically pleasing snow cover to be obtained, in the case of ski runs that have both areas of frozen snow cover and areas of relatively soft snow cover.

In addition, the free oscillation of the pressure bar around an axis parallel to the longitudinal axis is independent with respect to the tiller module and enables the pressure bar and the flexible mat to adapt to the transverse profile of the snow cover, even when the snow cover has relatively close variations in the traveling direction.

In particular, when the snow tiller processes a snow cover that has variations in slope or irregularities, such as holes or hollows, this free oscillation of the pressure bar makes it possible for the flexible mat to remain in constant contact with the snow cover to obtain an optimal and relatively aesthetically pleasing snow cover.

According to certain embodiments, the adjusting assembly is configured to selectively control the pressure bar's oscillating around an axis transverse to the longitudinal axis in order to adjust the distance between the pressure bar and the casing. In this way, its construction is relatively simple and effective.

According to certain embodiments, at least one adjusting assembly comprises a crossbar, which extends transversely to the longitudinal axis, and is coupled to the pressure bar and, by a first universal joint, to the frame. It should be appreciated that via the first universal joint, it is possible to enable the crossbar and the pressure bar to freely oscillate around an axis passing through the first universal joint and substantially parallel to the longitudinal axis and the crossbar and pressure bar to oscillate in a controlled manner around an axis passing through the first universal joint and transverse to the longitudinal axis.

According to certain embodiments, the adjusting assembly comprises a linear actuator coupled to the frame via a second universal joint and coupled to the crossbar via a third universal joint. The linear actuator is, in this embodiment, configured to control the crossbar's oscillating around an axis passing through the first universal joint transversal to the longitudinal axis in order to adjust the distance between the pressure bar and the easing.

By connecting the linear actuator via the second and third universal joint, it is possible to enable the crossbar to freely oscillate around an axis parallel to the longitudinal axis and passing through the first universal joint.

According to certain embodiments, the second universal joint comprises an articulated head and/or the third universal joint comprises an articulated head.

According to certain embodiments, a plane on which the rotation axis lies, and passing through the first universal joint, identifies a spatial region below the plane, the pressure bar and the end of the flexible mat coupled to the casing being arranged in said spatial region.

In practice, the rear end of the casing, to which the flexible mat is coupled, is slightly higher than the pressure bar.

According to certain embodiments, the pressure bar is coupled to the crossbar and to the flexible mat so as to enable a substantially translatory movement of the pressure bar along a direction substantially parallel to the longitudinal axis.

According to certain embodiments, the pressure bar is made up of sections, which are rigid and coupled to each other so as to enable relative small oscillations between the sections with respect to axes substantially parallel to the longitudinal axis, the cross bar being connected to each section by a connecting element shaped like an articulated head. In this way, it is possible to follow curved transverse profiles.

According to certain embodiments, the cross bar is coupled to the pressure bar so that the cross bar and the pressure bar are configured to oscillate solidly around an axis passing through the first universal joint and transverse to the longitudinal axis.

According to certain embodiments, the linear actuator comprises a double-acting hydraulic cylinder controlled by three.

BRIEF DESCRIPTION OF THE DRAWINGS

Further features and advantages of the present disclosure will be apparent from the following description of a non-limiting embodiment thereof, with reference to the attached flanges, wherein.

DETAILED DESCRIPTION

Figure 1:
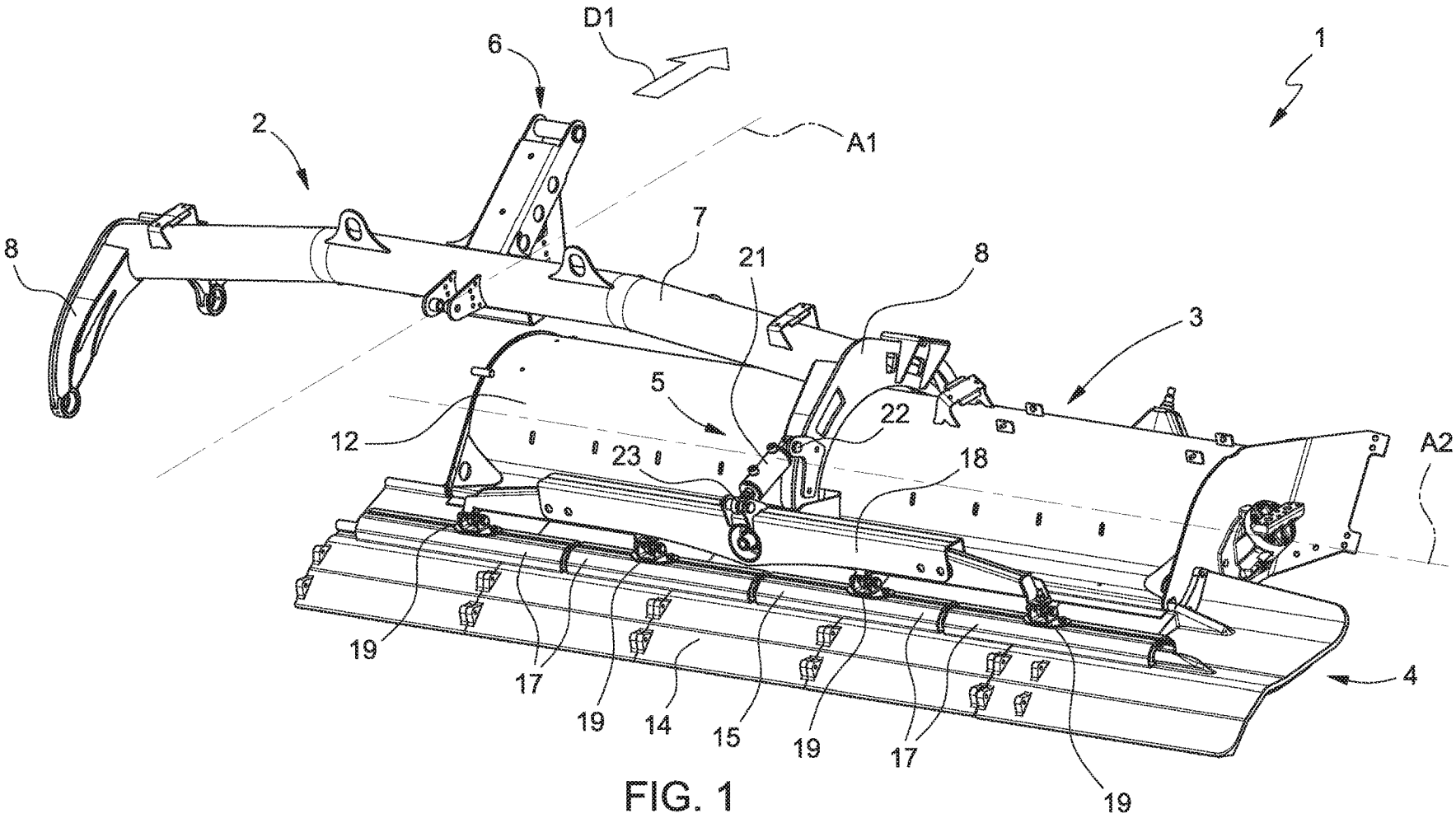
FIG. 1 is a perspective view, with parts removed for clarity of a snow tiller in accordance with the present disclosure.
Figure 2:
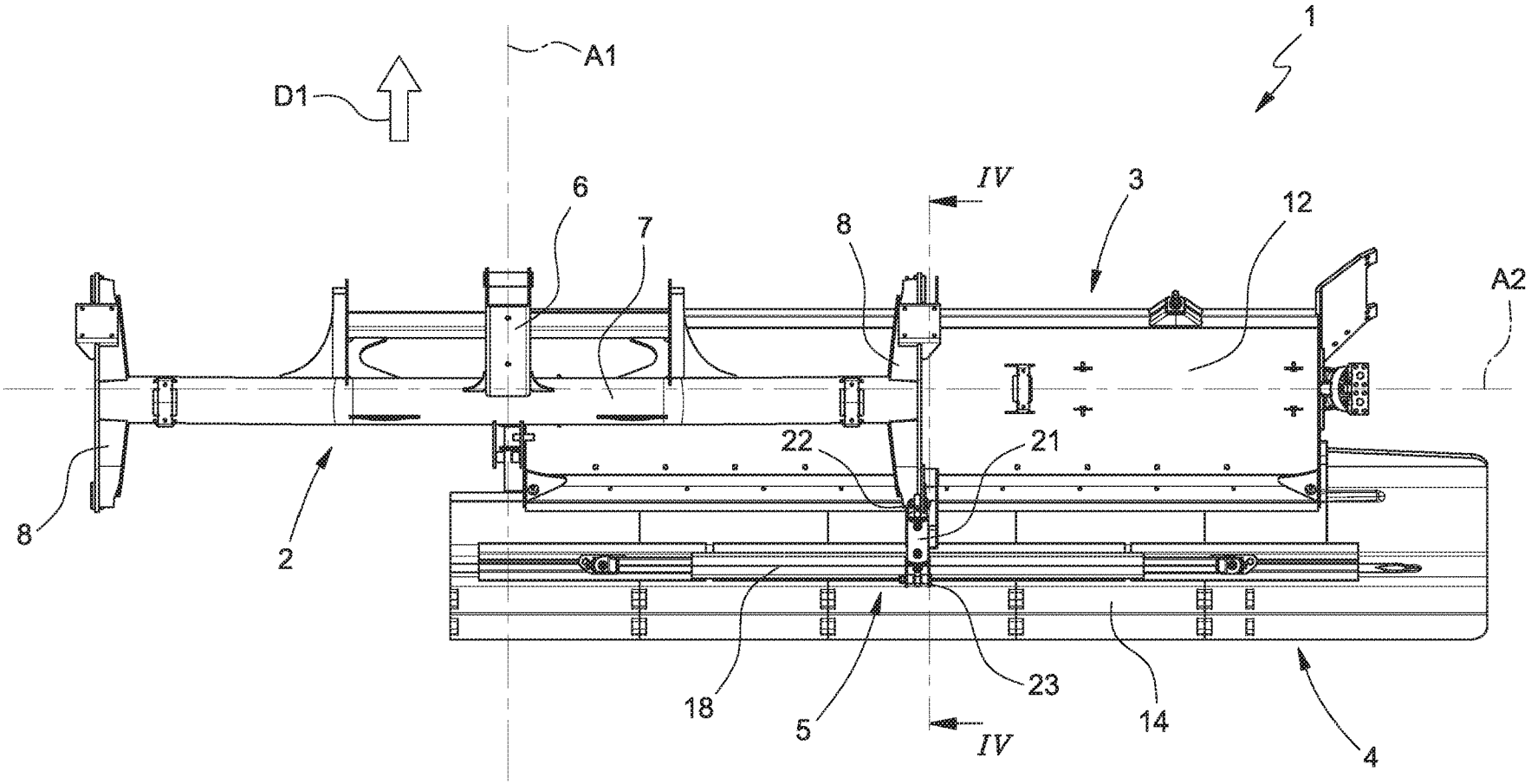
FIG. 2 is a view from above with removed for clarity, of the snow tiller in FIG. 1.

With reference to FIGS. 1 and 2, the number 1 indicates a snow tiller 1, as a whole, for the preparation of the snow cover on ski runs. The snow tiller 1 mainly extends symmetrically on opposite sides with respect to a longitudinal axis A1 and is configured to be dragged over the snow cover in a traveling direction D1 via a tracked vehicle (not shown in the figures). The snow tiller 1 is connected via a drawbar (not shown in the figures) to the tracked vehicle (not shown).

Throughout the present description, the terms "front", "rear", "frontal", and "side" will specifically refer to the traveling direction D1 of the snow tiller 1.

The snow tiller 1 comprises a frame 2; two tiller modules 3 (one of which is not shown) supported by the frame 2 and substantially aligned in a transverse direction with respect to the longitudinal axis A1; a finisher 4 at the rear; and an adjusting assembly 5 for each tiller module 3.

The frame 2 comprises a front hitch 6 configured to be connected to the drawbar (not shown in the figures); a support bar 7; two forks 8, each of which is configured to support a respective tiller module 3 and to enable small oscillations of the tiller module 3 around an axis parallel to the longitudinal axis A1.

Each tiller module 3 is suspended from the respective fork 8, so that a tiller module can oscillate, and is hinged to the adjacent tiller module 3. Such a configuration provides that the snow tiller 1 is able to adapt to the ground hollows transverse to the traveling direction D1.

Figure 3:
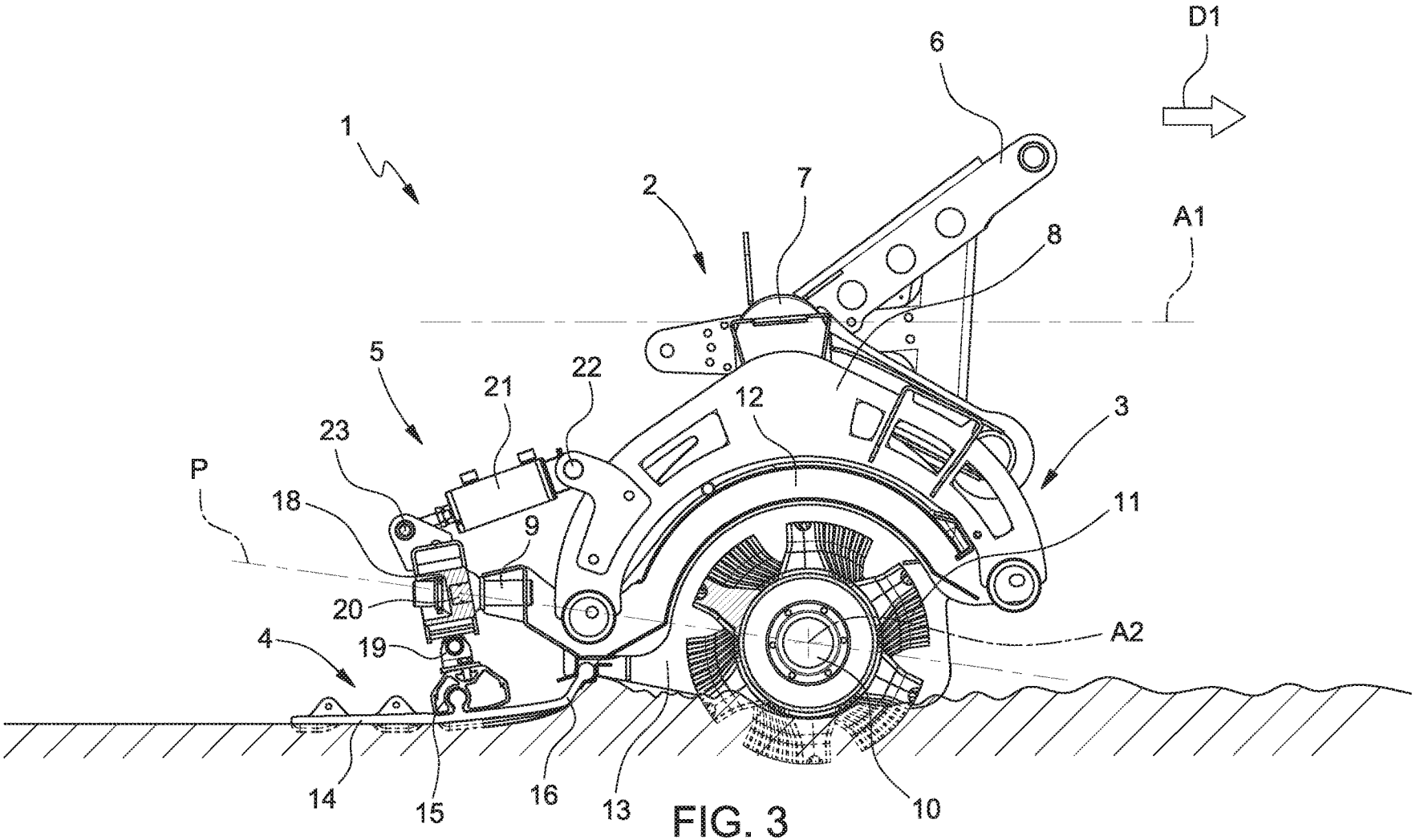
FIGS. 3 and 4 are section views, with parts removed for clarity, of the snow tiller in FIG. 1 along the section lines IV-IV, and in respective operating configurations.
Figure 4:
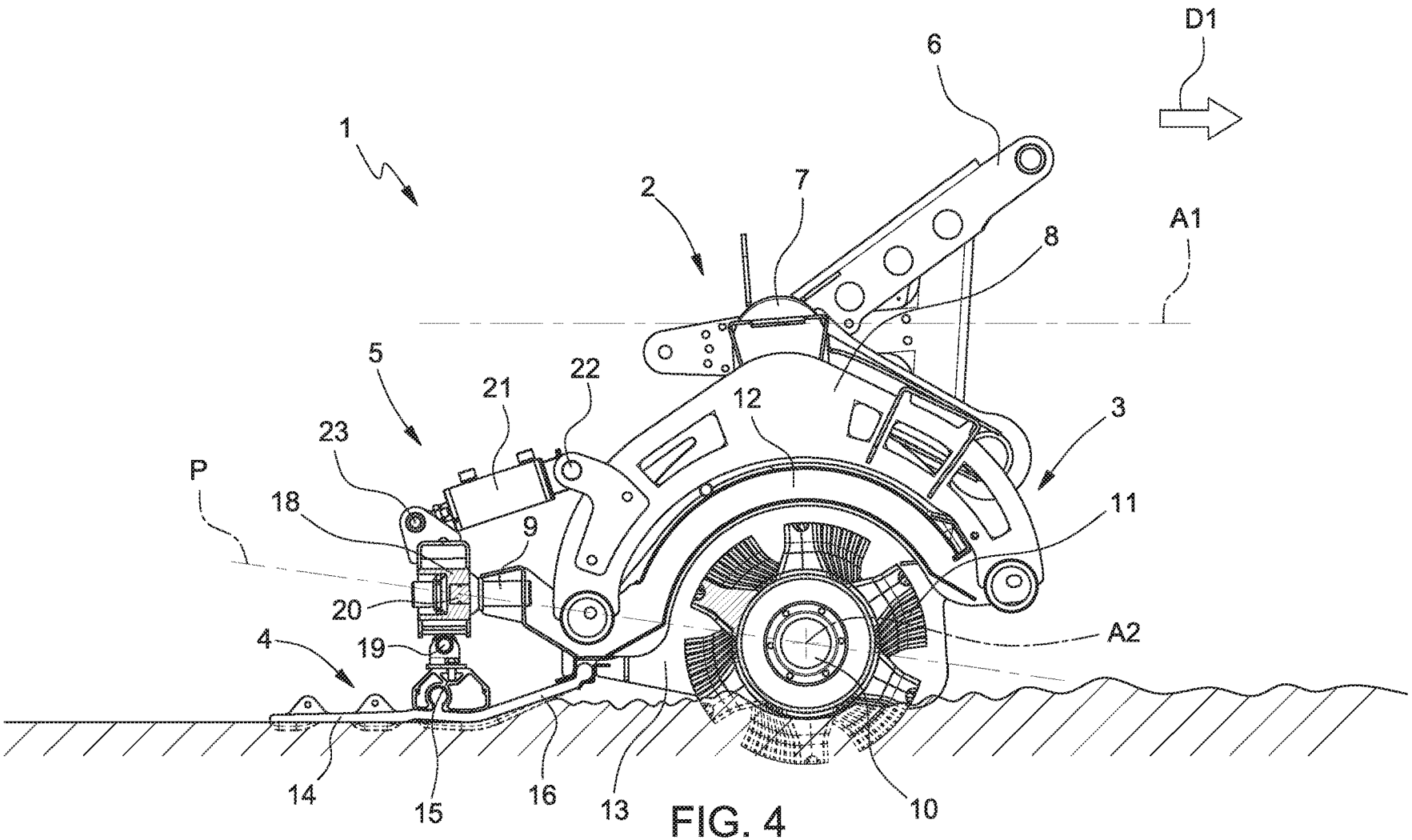

With reference to FIGS. 3 and 4, the frame 2 comprises a support 9 coupled to a respective fork 8 and configured to support the adjusting assembly 5.

Each tiller module 3 comprises a motorised shaft 10, which rotates around a rotation axis A2 that extends in a direction substantially transversal to the longitudinal axis A1 and is equipped with a plurality of tools 11 configured to penetrate the snow cover; and a easing 12 arranged around the shaft 10 and configured to define a processing chamber 13 in which the snow is processed. In the embodiment shown, the casing 12 also has a bearing function to support the shall 10 and to connect the tiller module 3 to the frame 2.

The finisher 4 comprises a flexible mat 14 coupled to the casing 12 to define the continuation of the casing 12; and a pressure bar 15 that extends in a direction transverse to the longitudinal axis A1 and is fixed above the flexible mat 14.

The flexible mat 14 comprises a portion 16 that extends from the casing 12 to the pressure bar 15 and can be configured according to the distance between the pressure bar 15 and the casing 12.

With reference to FIG. 1, the pressure bar 15 is made up of sections 17, which are rigid and coupled to each other so as to enable relative small oscillations between adjacent sections 17 around axes substantially parallel to the longitudinal axis A1 and, thus, to adapt the pressure bar 15 and the flexible mat 14 to the irregularities and undulations of the snow cover transversely to the traveling direction D1. In certain embodiments, the sections 17 are made of a metallic material, such as aluminium.

The adjusting assembly 5 comprises a crossbar 18 that extends transversely to the longitudinal axis A1 directly above the pressure bar 15, and is coupled to the pressure bar 15 and to the support 9.

In particular, the crossbar 18 is connected to each section 17 of the pressure bar 15 via respective connecting elements 19.

In a particular, non-limiting embodiment of the present disclosure, each connecting element 19 comprises an articulated head so as to enable relative small independent oscillations of each section 17 of the pressure bar 15 around a plurality of axes passing through the respective articulated head.

With reference to FIGS. 3 and 4, the adjusting assembly 5 comprises a universal joint 20 to connect the crossbar 18 to the support 9, and a linear actuator 21, which is coupled to the frame 2 via a universal joint 22 and to the crossbar 18 via a universal joint 23.

The linear actuator 21 is a hydraulic cylinder selectively controlled by force and in a position to adjust the distance between the pressure bar 15 and the casing 12.

In a non-limiting example of the present disclosure, the snow tiller 1 comprises two adjusting assemblies 5, in which each linear actuator 21 is coupled to the respective fork 8 and in which each crossbar 18 is coupled to the respective support 9.

In more detail, a housing for the universal joint 20, such as a spherical joint, is located in the central portion of the body of the crossbar 18.

In a non-limiting embodiment of the present disclosure, the linear actuator 21 is a double-acting hydraulic cylinder the ends of which are coupled, respectively, to the frame 2 via a universal joint 22 and to the crossbar 18 via a universal joint 23.

In particular, a central portion of the crossbar 18 comprises a seat configured to be connected to the linear actuator 21 via the universal joint 23, which comprises an articulated head.

In use, the adjusting assembly 5 enables the selective adjustment of the distance between the pressure bar 15 and the casing 12, via adjusting the length of the linear actuator 21. The adjustment of the distance between the pressure bar 15 and the casing 12 enables the configuration of the portion 16 of flexible mat 14, between the pressure bar 15 and the casing 12, to be adjusted, thus varying the amount of snow present in the processing chamber 13. In particular, with reference to FIG. 3, when the linear actuator 21 is extended, the crossbar 18 rotates counter-clockwise around an axis passing through the universal joint 20 and parallel to the extension direction of the crossbar 18, causing the pressure rod 15 to approach the casing 12. In this configuration, the portion 16 of the flexible mat 14 is compressed and arches, defining a concavity towards the top.

In contrast, with reference to FIG. 4, when the linear actuator 21 is retracted, the distance between the pressure bar 15 and the casing 12 is greater than when the linear actuator 21 is extended. In this configuration, the portion 16 of flexible mat 14 is stretched out and takes on a substantially flat shape. In this configuration, the accumulation of snow in the processing chamber 13 is reduced. The configuration shown in FIG. 4 with a substantially reduced snow accumulation is suitable for processing snow covers with fresh or soft snow, while the configuration in FIG. 3 accommodates a greater snow accumulation in the processing chamber 13 and is suitable for working with icy snow covers.

In a particular embodiment, the length of the linear actuator 21 is manually controlled by the driver of the tracked vehicle via a special control interface arranged in the cab (not shown in the figures).

In a particular embodiment, the length of the linear actuator 21 is controlled automatically. In particular, the length of the linear actuator 21 is controlled according to some parameters detected by special sensors (not shown in the figures), such as according to the properties of the snow cover, the height of the shaft 10 with respect to the snow cover, and the position of the shaft 10 with respect to the casing 12.

Figure 5:
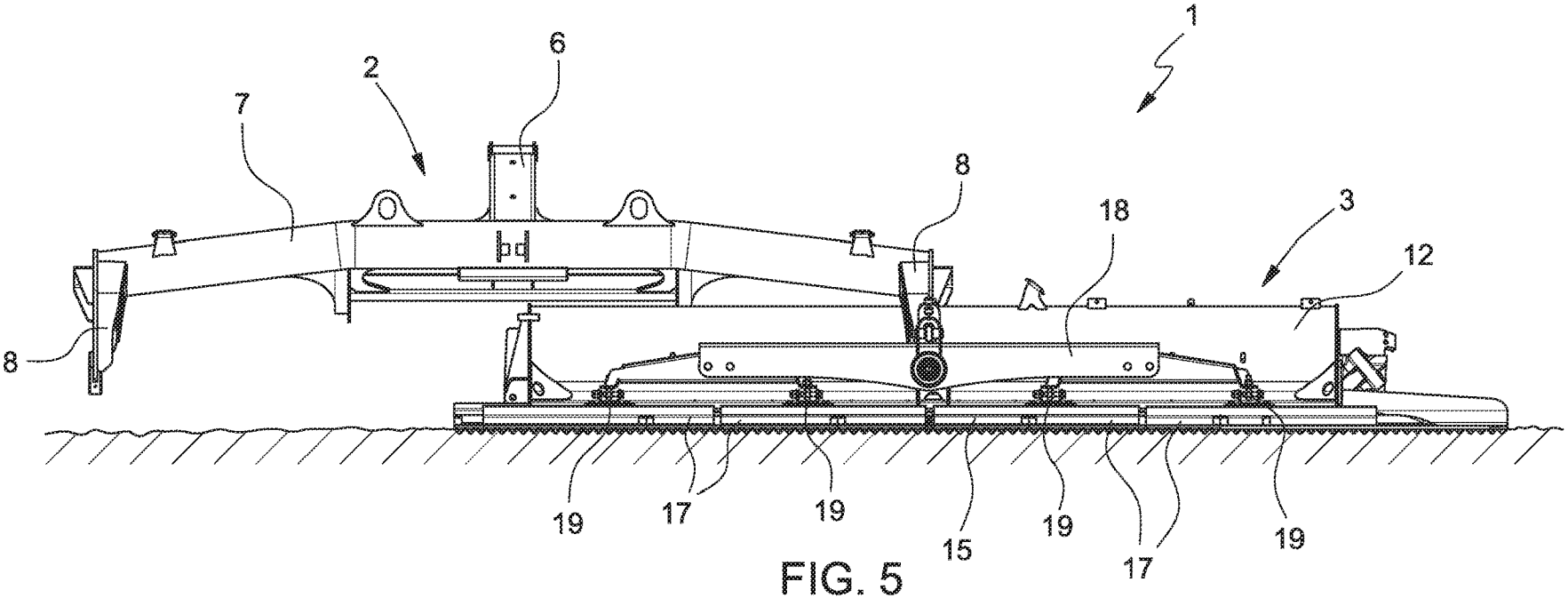
FIGS. 5 and 6 are rear views, with parts removed for clarity, of the snow in FIG. 1 in respective operational configurations.
Figure 6:
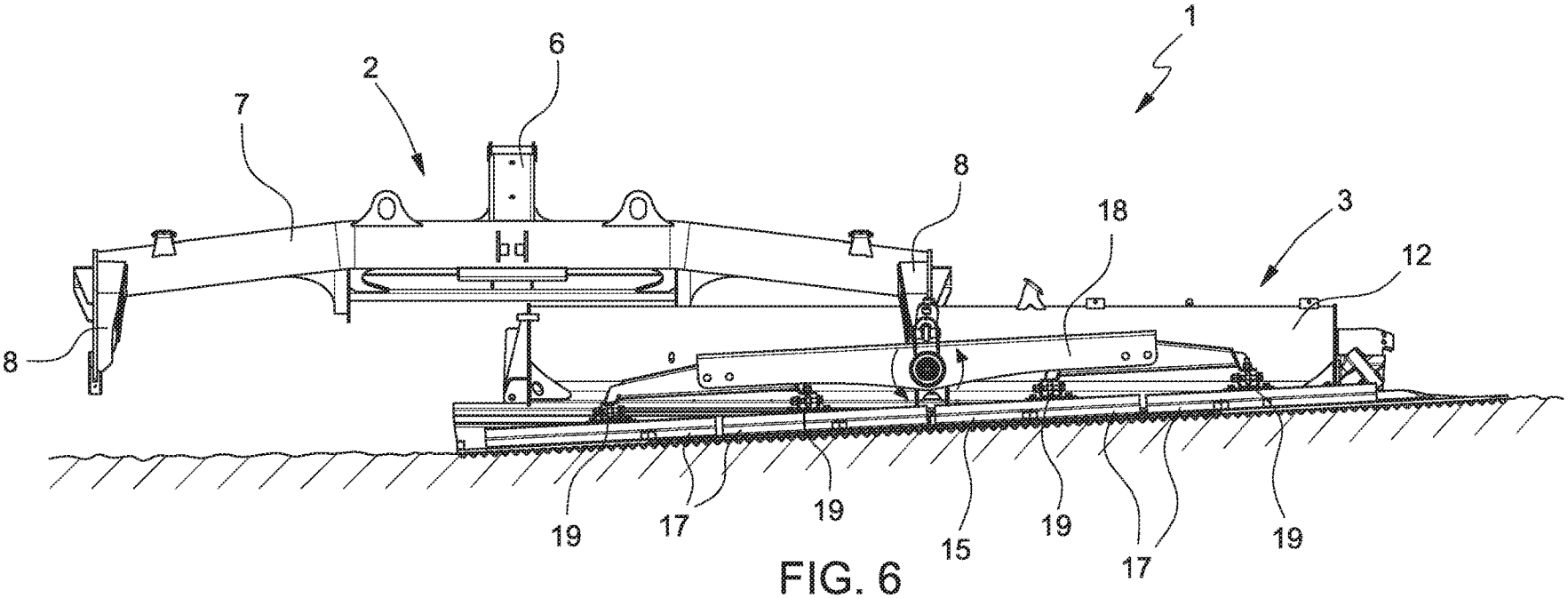

With reference to FIGS. 5 and 6, the universal joint 20, such as a spherical joint, enables the crossbar 18 to oscillate, in a controlled manner, around an axis transverse to the longitudinal axis A1 and passing through the universal joint 20 in order to adjust the distance between the pressure bar 15 and the casing 12. However, it also enables the crossbar 18 to oscillate freely around the universal joint 20 to adapt the pressure bar 15 and the flexible mat 14 to the transverse profile of the ski run, independently of the tiller module 3. In this way, the flexible mat 14 is able to remain in constant contact with the snow cover, even when the ski run has relatively close variations in the transverse profile in the traveling direction D1.

The adaptation of the pressure bar 15 to the snow cover conformation is also favoured by the connecting elements 19 comprising the articulated heads that make it possible for each section 17 to make relative small independent oscillations around a plurality of axes.

In a particular, non-limiting embodiment of the present disclosure, a plane P on which the rotation axis A2 lies and passing through the universal joint 20 identifies first spatial region above the plane P and a second spatial region below the plane P. The linear actuator 21 is arranged in the first spatial region, while the pressure bar 15 and the end of the flexible mat 14, which is connected to the casing 12, are arranged in the second spatial region. It should be appreciated that based on the possibility of adjusting the configuration of the portion 16 of the mat 14, the amount of snow contained in the processing chamber 13 can be selectively adjusted so as to enable sufficient snow accumulation, when processing a snow cover, in order to level out irregularities in the snow cover or to avoid excessive amounts of tilled snow in the processing chamber 13 when not required.

Variations can be made to the present disclosure without departing from the scope of the appended claims. As such, the present disclosure also covers embodiments that are not described in the detailed description and equivalent embodiments. Accordingly, various changes and modifications to the presently disclosed embodiments will be apparent to those skilled in the art.

The invention claimed is:

1. A snow tiller configured to be advanced in a traveling direction, the snow tiller comprising:

a frame configured to extend symmetrically on opposite sides of a longitudinal axis parallel to the traveling direction;

at least one tiller module coupled to the frame and comprising:

a shaft configured to rotate around a rotation axis transverse to the longitudinal axis and equipped with a plurality of tools configured to penetrate a snow cover of a ski run, and a casing arranged around the shaft;

a finisher comprising:

a flexible mat configured to define a support area on the snow cover and comprising an end coupled to the casing, and a pressure bar configured to extend transverse to the longitudinal axis, the pressure bar being fixed to the flexible mat at a distance from the end coupled to the casing; and an adjusting assembly comprising:

a crossbar configured to extend transverse to the longitudinal axis, the crossbar coupled to the pressure bar and coupled, via a first universal joint, to the frame, and a linear actuator coupled, via a second universal joint, to the frame and coupled, via a third universal joint, to the crossbar, the linear actuator configured to control an oscillation of the crossbar relative to an axis passing through the first universal joint and transverse to the longitudinal axis to adjust the distance between the pressure bar and the casing, wherein the adjusting assembly is connected to the pressure bar and at least one of the frame and the casing, and the adjusting assembly is configured to:

enable a free oscillation of the pressure bar relative to an axis parallel to the longitudinal axis, and selectively adjust the distance between the pressure bar and the casing.

2. The snow tiller of claim 1, wherein the adjusting assembly is configured to selectively control a free oscillation of the pressure bar relative to an axis transverse to the longitudinal axis to adjust the distance between the pressure bar and the casing.

3. The snow tiller of claim 1, wherein at least one of the second universal joint and the third universal joint comprises an articulated head.

4. The snow tiller of claim 1, wherein the linear actuator comprises a double-acting hydraulic cylinder controllable by force.

5. The snow tiller of claim 1, wherein a plane on which the rotation axis lies and which passes through the first universal joint identifies a spatial region under the plane in which the pressure bar and the end of the flexible mat coupled to the casing are configured to be arranged.

6. The snow tiller of claim 1, wherein the pressure bar is coupled to the crossbar and to the flexible mat to enable a translatory movement of the pressure bar along a direction parallel to the longitudinal axis.

7. The snow tiller of claim 6, wherein:

the pressure bar comprises a plurality of sections that are rigid and coupled to each other to enable relative oscillations between the sections with respect to the axis parallel to the longitudinal axis, and the crossbar is connected to each section by a connecting element having an articulated head shape.

8. The snow tiller of claim 1, wherein the crossbar is coupled to the pressure bar such that the crossbar and the pressure bar are configured to oscillate relative to an axis passing through the first universal joint and transverse to the longitudinal axis.

* * * * *